US006696971B2

(12) United States Patent
Tukin

(10) Patent No.: US 6,696,971 B2
(45) Date of Patent: Feb. 24, 2004

(54) AUDIBLE COMBINATION LIGHT SOCKET-ADAPTER

(76) Inventor: Gess Tukin, 2169 Rule Ave., Maryland Heights, MO (US) 63043

( * ) Notice: Subject to any disclaimer, the term of this patent is extended or adjusted under 35 U.S.C. 154(b) by 62 days.

(21) Appl. No.: 10/020,347

(22) Filed: Dec. 12, 2001

(65) Prior Publication Data

US 2003/0107496 A1 Jun. 12, 2003

(51) Int. Cl.[7] ..... G08B 23/00; G08B 13/18; G08B 13/00

(52) U.S. Cl. ..... 340/693.5; 340/693.6; 340/693.9; 340/691.8; 340/692; 340/691.1; 340/565; 340/556; 340/555; 340/566

(58) Field of Search ..... 340/552, 553, 340/554, 555, 556, 557, 565, 567, 566, 691.1, 692, 691.8, 693.5, 693.9, 693.6

(56) References Cited

U.S. PATENT DOCUMENTS 4,980,672 A * 12/1990 Murphy ..... 340/571
5,371,489 A * 12/1994 Carroll et al. ..... 340/565
5,432,500 A * 7/1995 Scripps ..... 340/628
5,555,454 A * 9/1996 Dees ..... 340/332
6,049,274 A * 4/2000 Stachurski ..... 340/541
6,078,257 A * 6/2000 Ferraro ..... 340/568.1
6,242,872 B1 * 6/2001 Ha ..... 315/293

* cited by examiner

*Primary Examiner*—Jeffery Hofsass
*Assistant Examiner*—Lam P Pham
(74) *Attorney, Agent, or Firm*—Polster, Lieder, Woodruff & Lucchesi

(57) ABSTRACT

An adapter (10) for a light fixture (F) has a socket (16) into which the base of the light bulb (L) is screwed. The adapter has a base (12) sized to be inserted in a socket of the light fixture for attaching the adapter to the light fixture. The adapter further includes a housing (14) in which is installed an audio alarm (20) for a security system. The audio alarm is electrically operated and connected in parallel with the light bulb. Electrical current routed to the adapter through the light fixture simultaneously illuminates the light bulb screwed into the socket of the light holder and the audio alarm.

9 Claims, 2 Drawing Sheets

AUDIBLE COMBINATION LIGHT SOCKET-ADAPTER

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to light fixtures such as light fixtures installed on the sides of buildings or mounted on posts; and more particularly, to a screw-in adapter or the like which provides a light socket for a lamp and incorporates an audio alarm for a security system monitoring the premises.

Motion detector systems are frequently used to safeguard office buildings, manufacturing plants and warehouses, as well as a person's home. Such systems often are used in conjunction with lighting systems by which the premises is illuminated. The lighting system can be "on" all the time, or activated when someone's presence is sensed by the motion detector. Commercial indoor and outdoor lighting systems usually include a light fixture accommodating one or more high intensity lights which provide illumination to areas around the protected property. As is well known in the art, motion detector systems can be used to set off audio alarms when the presence of someone moving about the premises is detected.

Installation of a motion detector system and its associated alarms can be involved and expensive, particularly where the system is being incorporated with already existing lighting. The present invention provides for an adapter which can be used with current lighting fixtures to provide a low cost, easy to install alarm whose operation is controlled by the motion detector system.

BRIEF SUMMARY OF THE INVENTION

Among the several objects of the present invention is an adapter for use with a conventional light fixture having a lampholder into which a light bulb is screwed. The adapter is screwed into the lampholder. The adapter itself includes a receptacle into which the light bulb is inserted. The adapter incorporates an audio alarm and associated electronic circuitry for turning the audio alarm on and off. Operation of the alarm is controlled by the motion detector with power to illuminate the light also being used to operate the audio alarm. The adapter is a low cost unit which is easy to install and remove.

Other objects and features of the invention will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
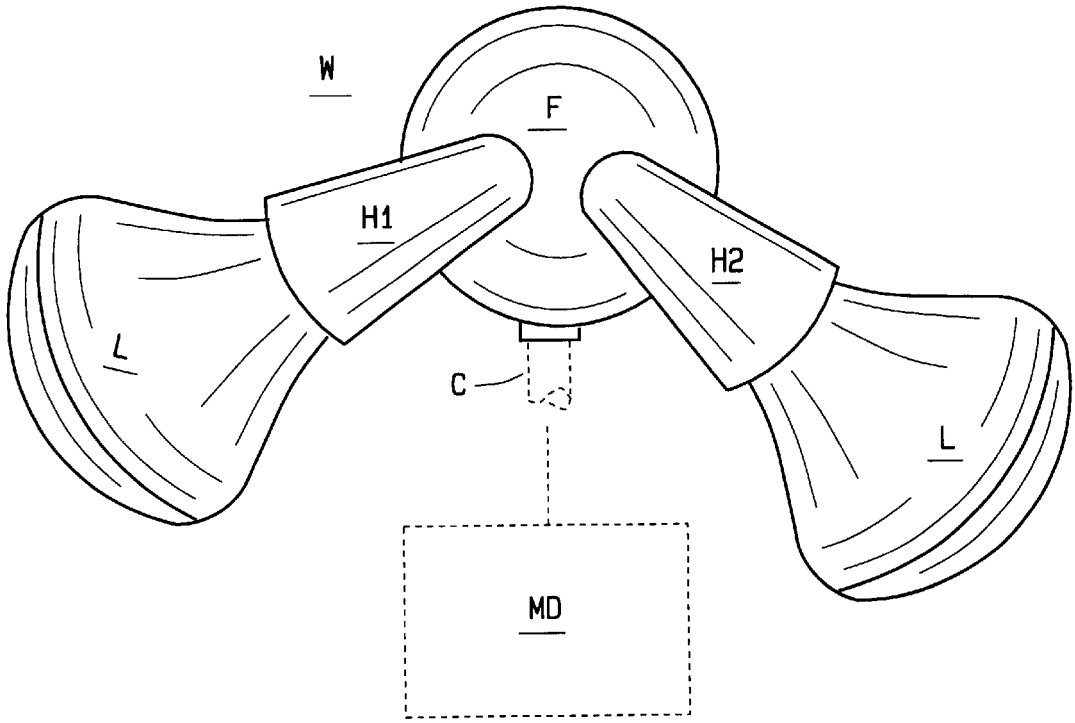
FIG. 1 illustrates a light fixture such as is used in conventional lighting systems.

Referring to the drawings, a lighting fixture F is shown in FIG. 1 to include a pair of lampholders H1, H2 into which lamps L are screwed, it being understood that some fixtures include only one holder. Electrical wiring to the fixture can either be routed to the fixture through a wall W to which the fixture is mounted; or, externally through a conduit C shown in phantom in FIG. 1. As also shown in FIG. 1, a motion detector MD can be installed adjacent the location of the light fixture, and wiring to and from the motion detector can be routed through the light fixture. As is known in the art, a motion detector is sensitive to movement within a predefined area monitored by the sensor. When the detector is "armed", as at night or when the premises is otherwise supposed to be secure, sensed motion with cause the motion detector to provide an alarm. This alarm can be a signal to a guard or the police to have them come inspect the premises for an intruder. Some motion detectors are also designed to trigger an audio alarm, and some are further designed to turn on lights.

Figure 2A:
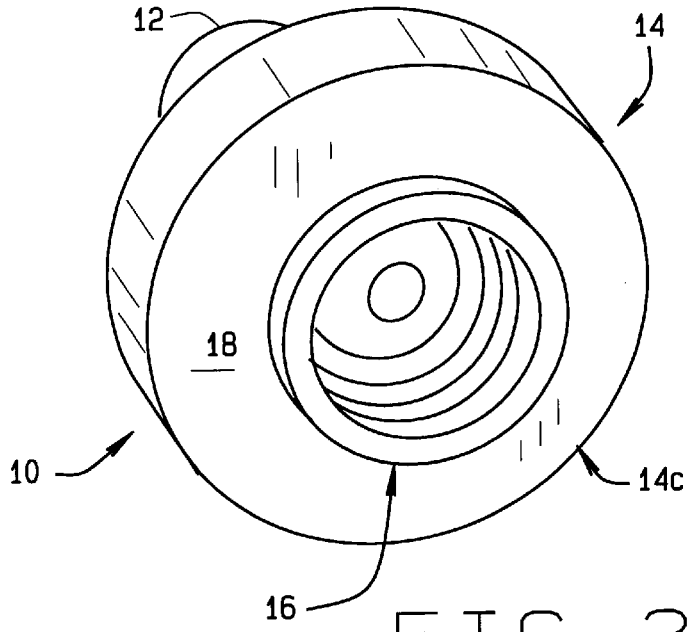
FIGS. 2A and 2B are different perspective views of an adapter of the present invention.
Figure 2B:
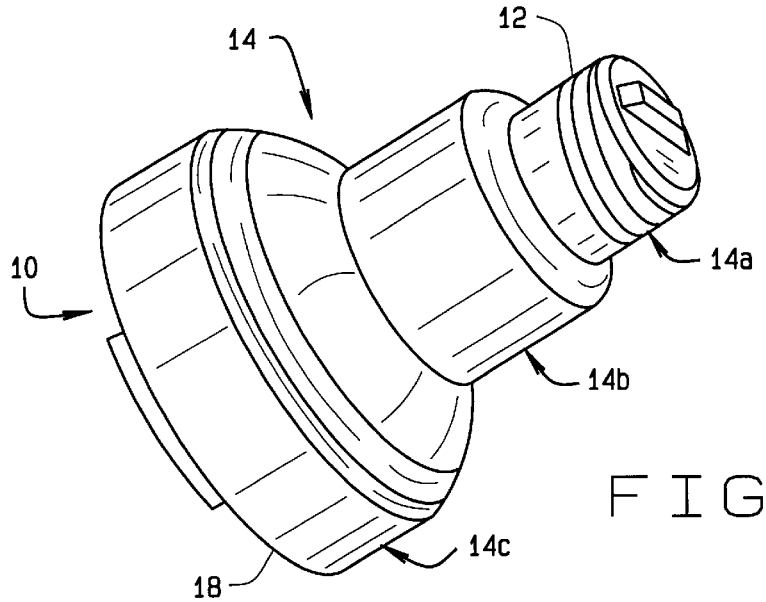
Figure 3:
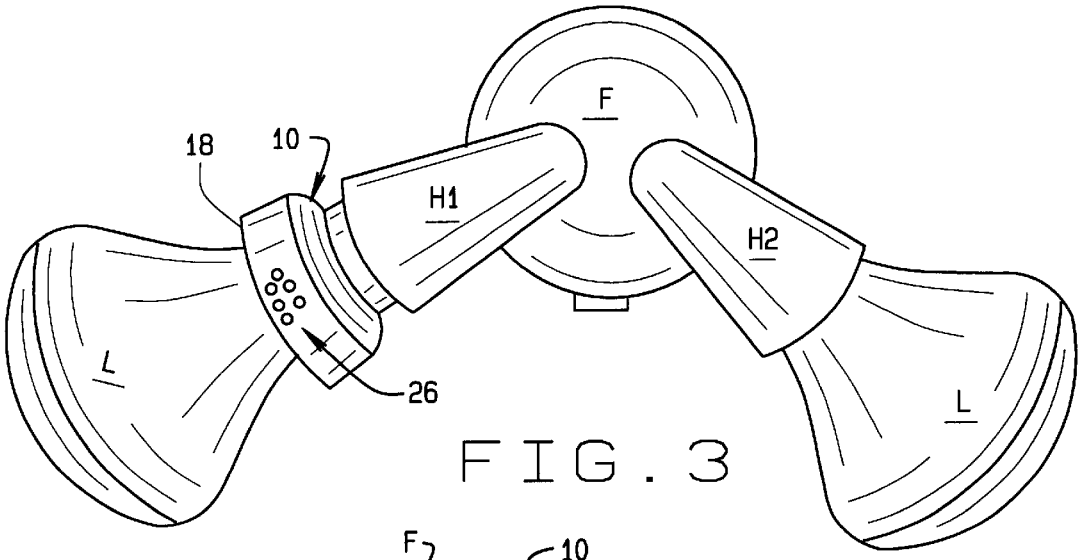
FIG. 3 illustrates installation of the adapter in the light fixture.

In FIGS. 2A and 2B, an adapter 10 of the present invention is shown. The adapter first has a threaded base 12 which screws into one of the lamp holders H1 or H2 as shown in FIG. 3. As such, base 12 is dimensionally the same as the base of lamp L so the adapter can be installed in the fixture in place of the lamp.

Next, adapter 10 includes has a generally circular housing 14 having three sections. The housing is made of a lightweight, non-electrically conductive material. A base section 14*a* of the housing comprises, as noted, two conductors (hot and neutral) forming a threaded base which is screwed into the lamp holder. An intermediate section 14*b* of the housing is larger in diameter than the base section, and an outer section 14*c of* the housing is larger in diameter than the intermediate section. A lamp socket 16 extends into the housing from its outer end 18 to the inner end of housing section 14*b*. The two conductors (hot and neutral), socket is sized to hold lamp L so that when the adapter is installed in fixture F, as shown in FIG. 3, the lamp L is inserted in the fixture. The base of the lamp socket 16 is electrically connected to base 12 of the adapter through housing section 14*a* so electrical current flows to the lamp mounted in the adapter. Accordingly, when the adapter is in place, the lamp will illuminate the same as when mounted in a holder H1, H2 of fixture F.

Figure 4:
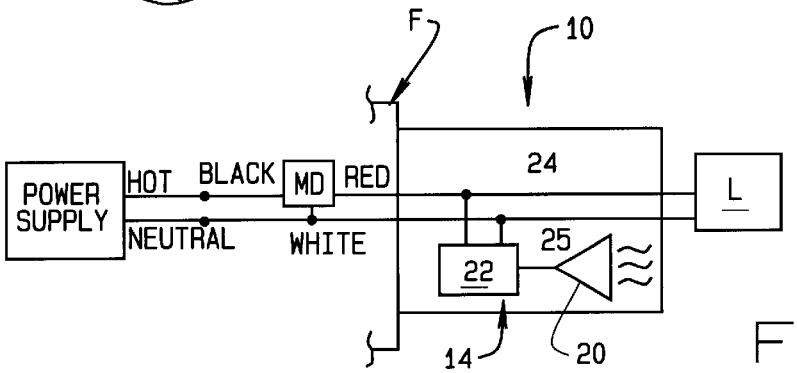
FIG. 4 is an electric schematic for the adapter.

Installed inside housing section 14*c* is an alarm 20 (see FIG. 4). Also installed in the housing is time delay relay 22 associated with the alarm. As shown in FIG. 4, the alarm and its relay are connected in parallel with lamp L as indicated at 24 and 25. The circuitry can, for example, provide a time delay between detection of movement and sounding of the alarm. The circuitry can also cause alarm 20 to sound continuously when activated; or to sound for a predetermined period of time then shut off, or to sound for a predetermined period, then shut off for another predetermined period, then sound again, and so forth as long, as lights stay "ON". The circuitry can also vary the audio level and frequency of the sound emitted by the alarm so the frequency can be constant, or alternate over a range of frequencies to produce a desired pattern of sound. If desired, openings 26 (see FIG. 3) are formed in a sidewall 28 of the housing to facilitate sound transmission for indoor application.

To install adapter 10, the user simply unscrews a lamp L from one of the holders, screws the adapter base into the lamp socket, and then screws the lamp into socket 16 of the adapter. Further, so long as the power is "on" and the motion detector is armed, whenever the motion detector senses motion, alarm 20 will be sounded, an activation signal for the alarm being routed through the electrical wiring for the fixture and turn light L "ON".

What has been described is an adapter 10 for use with a light fixture F. The adapter replaces a light bulb normally installed in the fixture. The light bulb is screwed into the adapter after the adapter is installed on the fixture. The adapter incorporates an audio alarm 20 for a motion detector system, and the alarm is sounded when the detector senses motion. Power for the audio alarm and its associated circuitry is provided in parallel with the light bulb.

In view of the above, it will be seen that the several objects and advantages of the present invention have been achieved and other advantageous results have been obtained.

What is claimed is:

1. An adapter for use in a light fixture having a socket into which a base of a light bulb is screwed comprising:

a housing one end of which is screwed into the socket of the light fixture in place of the light bulb for electrical current to the light fixture to flow to the adapter;

a light socket installed in the housing and into which the base of the light bulb is screwed for the electrical current to flow to the light bulb and illuminate the bulb;

an audio alarm for a security system mounted in the housing and electrically connected to the light socket for electrical current routed to the adapter through the light fixture to simultaneously illuminate the light bulb screwed into the socket of the adapter and the audio alarm; and, electrical circuitry controlling operation of the audio alarm and including a normally closed delay on make relay, the electrical circuitry and the relay being connected in parallel with the bulb and in series with the audio alarm, the relay providing a time delay between detection of a movement, which immediately energizes the light bulb and activates the audio alarm, and subsequent deactivation of the audio alarm.

2. The adapter of claim 1 in which the housing is formed of a lightweight, electrically non-conductive and weatherproof material.

3. The adapter of claim 1 wherein the housing includes a plurality of sections, a first section comprising the end of the housing screwed into the socket of the light fixture, and second and third sections through which the light socket installed in the housing extend, a base of the light socket installed in the housing being electrically connected to the first section of the housing, and the audio alarm and its associated electrical circuitry being installed in the third section of the housing.

4. The adapter of claim 3 wherein the first housing section is smaller in diameter than the second housing section, and the second housing section, which is an intermediate section between the ends of the housing, is smaller in diameter than the third housing section.

5. In a motion detector security system employing an audio alarm which is enabled when the system detects movement of an intruder on a premises being monitored, the improvement comprising adapter means for mounting the audio alarm to a light fixture located on the premises thereby to facilitate both the sounding of an alarm and illumination of the premises, the adapter means including:

a housing one end of which is screwed into a socket of the light fixture in place of a light bulb normally installed therein for electrical current to the light fixture to flow to the adapter;

a light socket installed in the housing and into which the base of the light bulb is screwed for the electrical current to flow to the light bulb and illuminate the bulb, the audio alarm for the security system being installed in the housing and electrically connected to the light socket thereof for electrical current routed to the adapter through the light fixture to simultaneously illuminate the light bulb screwed into the socket of the adapter and the audio alarm; and, electrical circuitry controlling operation of the audio alarm and including a normally closed delay on make relay, the electrical circuitry and the relay being connected in parallel with the bulb and in series with the audio alarm, the relay providing a time delay between detection of a movement, which immediately energizes the light bulb and activates the audio alarm, and subsequent deactivation of the audio alarm.

6. The improvement of claim 5 wherein the housing further is sized to house the electrical circuitry controlling operation of the audio alarm.

7. The improvement of claim 5 in which the housing is formed of a lightweight, electrically non-conductive and weather proof material.

8. The improvement of claim 5 wherein the housing includes a plurality of sections, a first section comprising the end of the housing screwed into the socket of the light fixture, and second and third sections through which the light socket installed in the housing extends, a base of the light socket installed in the housing being electrically connected to the first section of the housing, and the audio alarm and its associated electrical circuitry being installed in the third section of the housing.

9. The improvement of claim 8 wherein the first housing section is smaller in diameter than the second housing section, and the second housing section, which is an intermediate section between the ends of the housing, is smaller in diameter than the third housing section.

* * * * *